US006840009B2

(12) United States Patent
Ronay et al.

(10) Patent No.: US 6,840,009 B2
(45) Date of Patent: Jan. 11, 2005

(54) SLIDING WINDOW STRUCTURE WITH SASH GUIDING TRACKS

(76) Inventors: Maria Ronay, 629 Scarborough Rd., Briarcliff Manor, NY (US) 10510; Gabor Michels, Kortes u. 2, Paty 2071 (HU)

( * ) Notice: Subject to any disclaimer, the term of this patent is extended or adjusted under 35 U.S.C. 154(b) by 41 days.

(21) Appl. No.: 10/247,714

(22) Filed: Sep. 20, 2002

(65) Prior Publication Data

US 2003/0150165 A1 Aug. 14, 2003

(30) Foreign Application Priority Data

Feb. 14, 2002 (HU) ..... 0200569

(51) Int. Cl.[7] ..... E05D 15/26
(52) U.S. Cl. ..... 49/127; 49/128; 49/213
(58) Field of Search ..... 49/125, 127, 128, 49/129, 130, 209, 213, 214, 372, 373

(56) References Cited

U.S. PATENT DOCUMENTS

| | | | | | |
|---|---|---|---|---|---|
| 19,362 | A | * | 2/1858 | Haaps | 49/128 |
| 138,579 | A | * | 5/1873 | Perkins | 52/204.51 |
| 304,222 | A | * | 8/1884 | Morrison | 49/130 |
| 556,759 | A | * | 3/1896 | Lenz et al. | 49/128 |
| 745,645 | A | * | 12/1903 | Mundy | 49/125 |
| 755,982 | A | * | 3/1904 | Witte | 49/125 |
| 878,253 | A | * | 2/1908 | Straubhaar | 49/128 |
| 932,187 | A | * | 8/1909 | Straubhaar | 49/129 |
| 1,079,525 | A | * | 11/1913 | Veiser | 49/125 |
| 1,272,093 | A | * | 7/1918 | Ramberg et al. | 49/125 |
| 1,774,808 | A | | 9/1930 | Morton | |
| 1,942,239 | A | * | 1/1934 | Chauvet | 49/127 |
| 1,975,187 | A | * | 10/1934 | Aberle et al. | 49/128 |
| 2,169,343 | A | * | 8/1939 | Kaul | 49/127 |
| 2,229,026 | A | * | 1/1941 | Kirchner | 49/129 |
| 2,521,292 | A | * | 9/1950 | Hayman | 292/64 |
| 3,694,959 | A | * | 10/1972 | Gartner | 49/128 |
| 5,782,036 | A | * | 7/1998 | Bertieri et al. | 49/25 |

FOREIGN PATENT DOCUMENTS

| | | |
|---|---|---|
| GB | 401595 | 11/1933 |
| GB | 423838 | 2/1935 |

OTHER PUBLICATIONS

International Search Report, PCT/IB03/00361, Apr. 28, 2003, pp. 1–3.

* cited by examiner

*Primary Examiner*—Gregory J. Strimbu
(74) *Attorney, Agent, or Firm*—Connolly Bove Lodge & Hutz LLP; Larry J. Hume

(57) ABSTRACT

A sliding double hung window structure allows a window opening to be fully exposed to the external environment in an open position, with casements or windows being stored out of sight, and not in the opening. The window structure includes two casements or sashes balanced by suspended counterweights and guided by pins in guiding grooves in the two vertical sides of a frame of the window structure. In the closed position, the casements are located in the same plane, one on top of the other. When fully opened, a breast cavity under the window opening receives the two casements. The guiding grooves include guiding grooves in the window opening and in the breast cavity.

10 Claims, 4 Drawing Sheets

SLIDING WINDOW STRUCTURE WITH SASH GUIDING TRACKS

BACKGROUND OF THE INVENTION

This invention relates generally to a window structure, and more particularly to a sliding window structure that includes two casements (sashes) balanced by suspended counterweights, and even more particularly to sliding window structures commonly known as "double hung" windows, as might be found in Colonial style homes, for example.

Typically, in modem architecture, side-hinged windows, bottom-hung sashes, side-hinged and bottom hung windows, swivel frame windows, swinging windows and sash windows are used. A disadvantage of traditional side-hinged and bottom-hung windows is that in an open state, the side-hinged windows protrude deeply into the space of the room, whereas bottom-hung casements provide only limited possibility for allowing air to pass, and do not allow for a direct opening with the outside environment. A combination of these two types, side-hinged and bottom-hung windows, solves this problem relatively well, but producing operable hinges of appropriate load capacity imposes serious problems and significant costs.

In the case of swivel-swinging windows, the axis of rotation is aesthetically disturbing, and it is cumbersome to fix and to operate such windows. In one relatively simple solution, i.e., a double hung window arrangement, casements, or sashes, are movable separately in two glideways offset from and parallel to each other. This allows either the window on one side to be slid beside the other one, or the opposite way, or allows each of the casements (sashes) to be slid in the direction of the other. However, in all of these cases, double hung windows included, the free surface that may be provided is, at most, half of the area of the whole window opening.

Moreover, this solution is also aesthetically disadvantageous, since in the closed state, the two casements (sashes) are not in the same plane. Though sash-windows exist in which the casements (sashes) are in the same plane in their closed state, the free opening in this example is also only half of the whole window opening.

Experiments have also been carried out with casements transformable to opening casements after opening them, and pushing them to their place. The advantage of this solution is that the whole window opening can be made free, but its disadvantage is that the natural advantage of sash-windows, i.e., that a window opening of arbitrary size can be produced, is hindered by this solution.

Further, there is a significant demand for new window structures such as double hung windows in newly-constructed houses or in remodeled houses of the Colonial style, for example, which allow fully opening the casements to allow air flow into the house.

What is needed then is a sliding window structure which is producible with an arbitrary window opening size. What is further needed is a sliding window structure in which it is possible for the whole window opening to be opened to the external environment. What is still further needed is a sliding window structure in which the closed state can be produced by casements or sashes in one plane, and which is suitable as a substitute for conventional double hung windows in new construction homes or remodeled.

SUMMARY OF THE INVENTION

A preferred embodiment of the invention eliminates the above deficiencies, and provides a window structure making the opening of the whole window surface possible, and at the same time, producing intermediate window-openings of any size, and in which the closed state can be produced by casements (also called sashes) in one plane.

Moreover, in a first aspect of the invention, the casements do not provide any spatial limitations in their opened state. This objective can be achieved according to this aspect of the invention by a sliding window structure which includes two suspended, counterweight balanced casements or sashes led parallel to each other by pins in guide grooves provided in two vertical window posts.

In a preferred embodiment, the breast below the window contains a cavity suitable for receiving two parallel casement sashes side-by-side, so that the entire window opening may be made free of glass or casements, and the casements are stored out of sight. When the window opening is fully closed, the two parallel casements may be located in the same plane, one on top of the other. In intermediate positions, the two casements may be placed side-by-side, in either an upper portion of the window opening, or in a lower portion of the window opening.

In a further aspect of this embodiment, in relatively large sized windows and/or where there may be limited space below the window opening, for example, three parallel window sections may be used, wherein the uppermost window section is preferably in a fixed position, and the two other window sections are sliding window casements, as described above. In a closed position, for example, all three window sections are preferably arranged in the same plane.

In another embodiment which is a "rotated" variation of the traditional double hung window described above, the window casements may slide horizontally. Depending on the relative location of the window opening in a wall with respect to a corner, for example, the sliding window casements in a fully open position may both be placed in an horizontally adjacent "pocket" in the wall, or may be stowed one on either side of the window opening.

These and other features of the present application will be-come more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The features and advantages of the invention will be more readily understood upon consideration of the following detailed description of the invention, taken in conjunction with the accompanying drawings in which:

FIG. 1*a* shows the window structure in a closed position, and FIG. 1*h* shows the window structure in a fully open position;

DESCRIPTION OF PREFERRED EMBODIMENTS

Figure 1D:
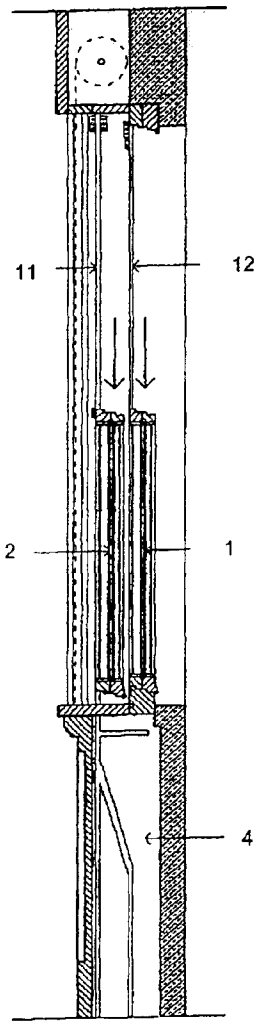
FIGS. 1*a*, 1*b*, 1*c*, 1*d*, 1*e*, 1*f*, 1*g* and 1*h* show the window structure according to an embodiment of the invention in a vertical section in different positions of the casements, for example.
Figure 1C:
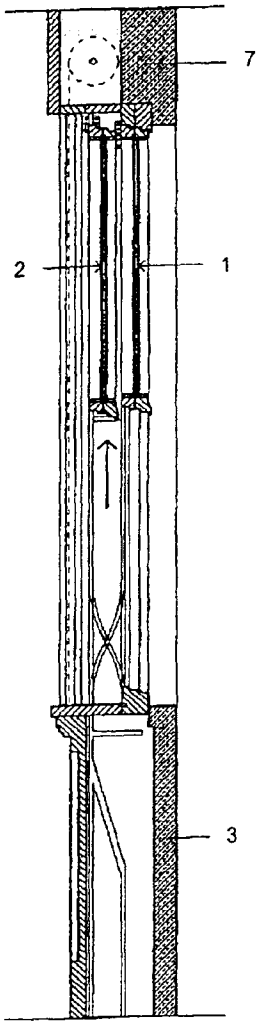

A preferred embodiment of the apparatus of the present invention is described below. Turning to FIGS. 1*a*–1*h*, window opening 8 is shown in wall 7. Under window opening 8, breast 3 of appropriate height is situated. According to one aspect of the invention, breast 3 is of a height at least half of the height of the window opening 8, and cavity 4 is developed in breast 3, being of a size suitable for receiving casements (also called sashes) 1 and 2 behind each other. The window structure preferably includes casements 1 and 2 guidable in a sash in a manner to be described later, with guiding pins on both sides of the window casements. A system of guiding grooves is built into the vertical sides of the window posts (not shown).

The system of guiding grooves preferably includes two parallel vertical sections 11 and 12 in the region of window opening 8, where vertical section 11 continues also into cavity 4 of breast 3. The two vertical sections 11, 12 may be connected by two crossing sections 14*a* and 14*b* in the lower region of window opening 8. The two vertical sections 11, 12 are preferably connected by a horizontal section 13 at the half height of the window opening.

Inside cavity 4 of breast 3, branching section 16 communicates with an upper portion of vertical section 11 within cavity 4. Above branching section 16, horizontal section 15 communicates with vertical section 11.

Figure 2:
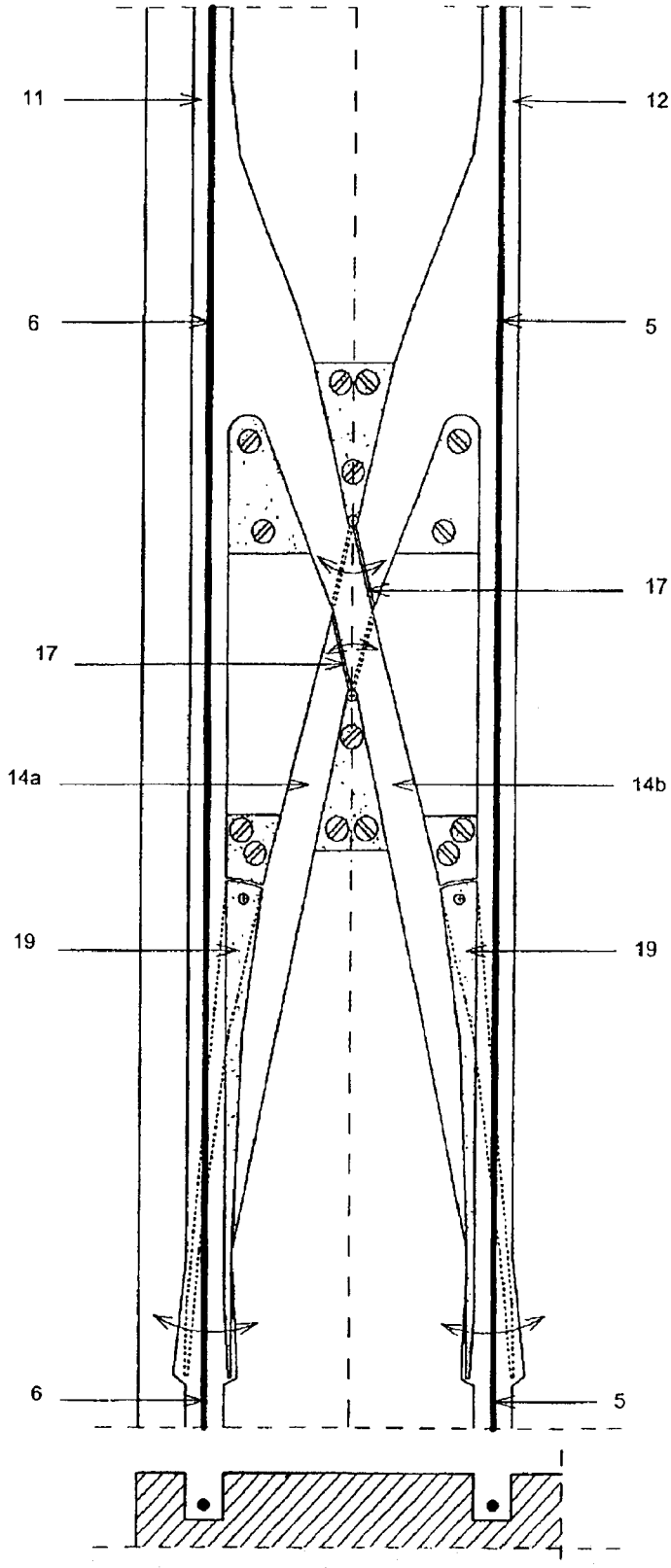
FIG. 2 provides an enlarged picture of the crossing section of the guiding grooves according to an embodiment of the invention.

FIG. 2 shows crossing sections 14*a* and 14*b* connecting vertical sections 11 and 12 in an enlarged picture. At the upper and lower crossing points of crossing sections 14*a* and 14*b*, tiltable direction changing turn-outs 17 are arranged, which make the guide groove open or free either in crossing section 14*a*, or in crossing section 14*b*, depending on the orientation of tiltable direction changing turn-outs 17. FIG. 2 shows also suspending cables 5, 6 for casements 1 and 2.

Figure 3:
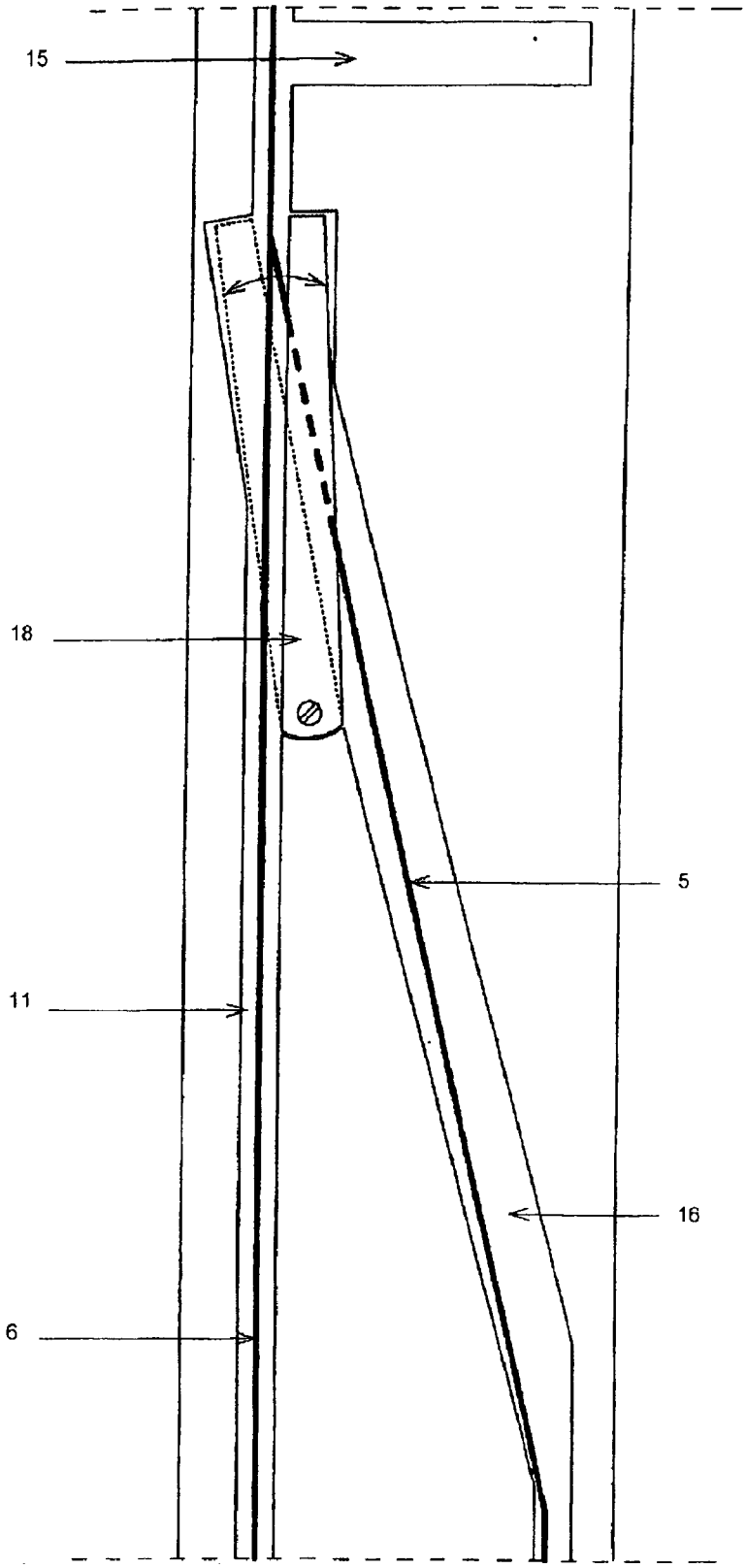
FIG. 3 provides an enlarged picture of the branching section of guiding grooves in the breast.

In FIG. 3, branching section 16, originating from the vertical section 11 and its branching site is shown enlarged. In this case, tiltable direction changing turn-out 18 is arranged, making either vertical section 11 or branching section 16 open or free, by simultaneously opening and closing the appropriate sections.

In the window structure according to the invention, window casements 1 and 2 may preferably be adjusted in different ways, as illustrated in FIGS. 1*a*–1*h*.

Figure 1B:
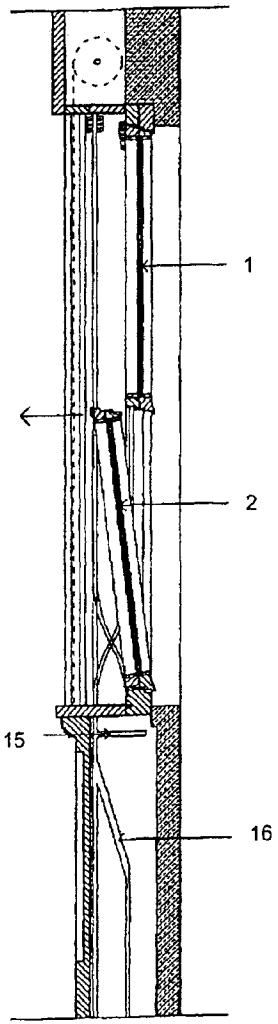
Figure 1A:
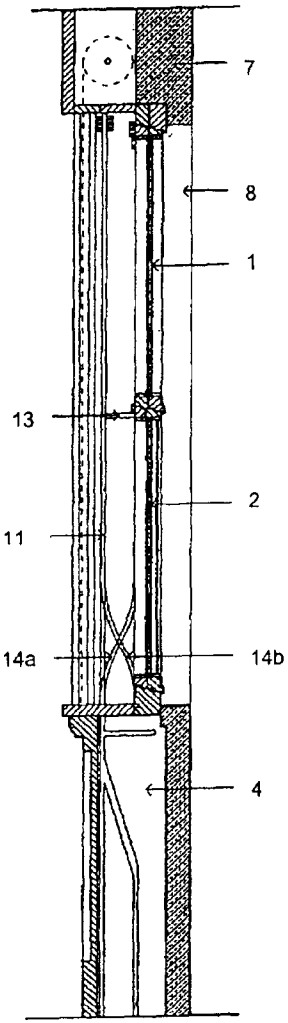

In FIG. 1*a*, i.e. in the closed position of the window structure, all the guiding pins of both casements 1, 2 are preferably situated in vertical section 12, i.e., both casements are arranged parallel, in the same plane, one on top of the other. In FIG. 1*b*, the upper guiding pin of casement 2 is moved in the direction of the arrow in connecting section 13, thus the guiding pin is placed into vertical section 11. Then, by moving casement 2 upwards, for example manually or by mechanized means (not shown), the lower guiding pin is placed into the appropriately adjusted crossing section 14 into vertical section 11, and casement 2 is moved upwards to its upper limit of travel or end position adjacent to casement 1, thus making the lower part of window opening 8 free.

Casements 1 and 2 may be made relatively easy to move and may also be relatively fixed in each location depicted, due to the effect of appropriately selected counterweights. After moving casement 2 to the upper position, a downward movement of casements 1 and 2 parallel to each other becomes possible, just by being guided by vertical sections 11 and 12. This way, the upper part of window opening can be made free, as depicted in FIG. 1*d*.

If, however, we want to make the whole of window opening 8 free or open, casement 2 may be moved downward, and branching section 16 may also be made free or open by means of direction changing turnout 18. In this case, after opening breast opening 20 either manually or by mechanized means (not shown), casement 2 moves downward until it reaches its lower limit of travel, which is essentially at the bottom of breast cavity 4. After that, the upper portion of casement 2 may be moved horizontally into horizontal section 15, thus bringing casement 2 into a vertical position.

Figure 1H:
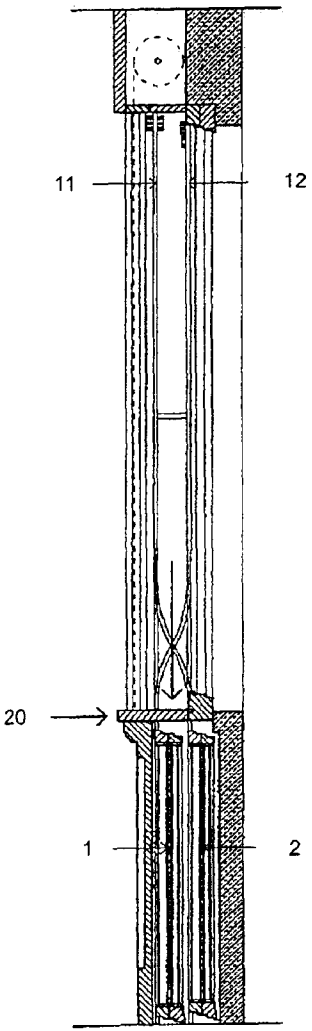
Figure 1G:
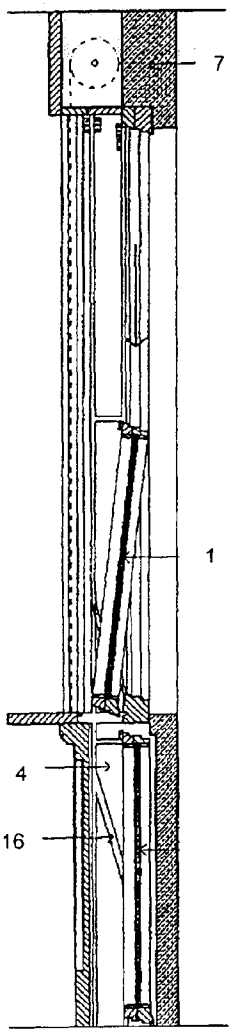
Figure 1F:
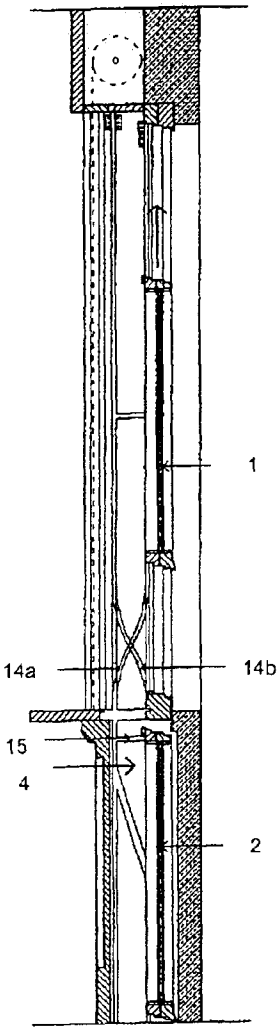
Figure 1E:
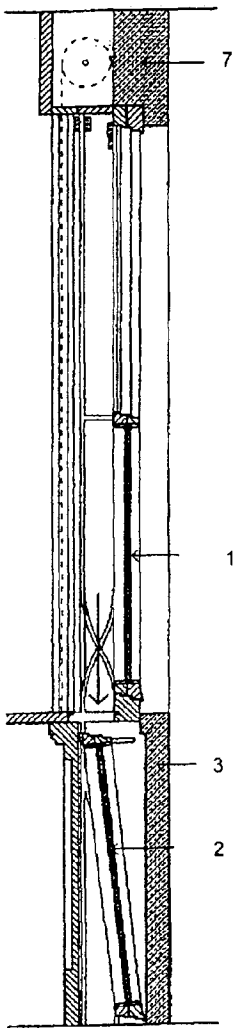

Following this, casement 1 may also be brought into a position above crossing section 14*a*, and crossing section 14*a* is made open or free by means of direction changing turn-out 17, and through this, casement 1 is moved downwards into breast cavity 4. However, for this, direction changing turn-out 18 has to be repositioned, to open or free the portion of vertical section 11 situated in breast 3. After that, casement 1 is moved downwards as shown in FIG. 1*g*, until it reaches its lower end position at the bottom of cavity 4, as illustrated in FIG. 1*h*, the position when window opening 8 is fully open.

From the operation of the window structure shown in FIGS. 1*a*–1*h*, it may be seen that with the window described above, the window may be in positions in which the window fully opened or closed, as well as any intermediate position, in an aesthetically pleasing way, without taking space away from the room. The window depicted in the Figures is manually operable, but may also be realized by known remote control techniques which control motorized movement and components (not shown).

For example, direction changing turnouts 17 and 18 may be actuated by known electromechanical means such as electrical relays and mechanical switching arms (not shown). A remote control device may actuate the mechanized movement of the window casements by use of infrared (IR) or radio frequency (RF) transmitter and receiver techniques and devices, or there could be a direct electrical wiring control unobtrusively connected to the mechanized window structure, by use of an electrical control switch located on the wall adjacent to the window, for example, to control the up and down movement of the casements, and to activate the direction changing turnouts.

Further, as mentioned above, the weight of casements 1 and 2 may be counterbalanced by suspended counterweights located within the outer portions of the window structure, as is conventionally known. Further, the guiding grooves may be made of metal, or of the same material of the casement or sash, whereas guiding pins on the sashes may include iron fittings, or fittings of other suitable material, e.g., corrosion resistant fittings.

In a further aspect of this embodiment (not shown), the sliding window structure may include three or more window sections. For example, for a large window opening, there may not be adequate space in the breast cavity between the floor and bottom of the window opening to allow sliding casements to be stowed, because each casement essentially has a height which is one-half the window opening. To overcome this problem, and to allow a relatively large opening to be obtained, the sliding window structure may include more than two casements. For example, there may be three window sections, in which the uppermost window section may be fixed, and the two lower window sections are sliding casements, as described above. In this way, larger window openings may be utilized for their light and aesthetic values, and still a relatively large portion of the window may be opened for air, using the novel approach detailed above.

Further, the third window section above may, in another aspect of this embodiment, also be slidable and stowable in the breast cavity (not shown), with appropriate modifications being made to the crossing section and associated direction changing turnouts to accommodate three tracks for sliding each of the three casements into the breast cavity.

In another embodiment which may be viewed as a "rotated" variation of the traditional double hung window described above, the window casements may be arranged to slide horizontally, rather than vertically. Depending on the relative location of the window opening in a wall with respect to a corner, for example, the sliding window casements, in a fully open position, may both be placed in the same horizontally adjacent "pocket" in the wall, or may be stowed one on either side of the window opening in two separated pockets.

Although discussion of a preferred embodiment of the present invention has been directed to a window structure having only two casements or sashes, it will be obvious that the present invention may be varied in many ways. For example, the window structure may also include, for larger window openings, more than two casements, with appropriate modification of the guiding grooves. Such variations are not to be regarded as a departure from the spirit and scope of the invention, and all such modifications as would be obvious to one skilled in the art are intended to be included within the scope of the following claims. The breadth and scope of the present invention is therefore limited only by the scope of the appended claims and their equivalents.

What is claimed as new and desired to be protected by Letters Patent of the United States is:

1. A sliding window structure suitable for fitting in a window opening, the window structure comprising:

two moveable casements moveable in vertical guiding grooves of a window opening section of the window structure, the two moveable casements each being capable of being located entirely in either of a first or a second vertical section in the window opening section;

a breast section arranged under the window opening section and having a cavity therein, a horizontal branching section having a groove arranged parallel to the first vertical section and communicating with one of the vertical guiding grooves at a branching point;

arched crossing grooves located in a lower portion of the window opening section; direction changing turn-outs arranged at crossing points of the arched crossing grooves and at the branching point of the horizontal branching section, wherein inner walls of the cavity include casement guiding grooves which may receive the two moveable casements, wherein the first vertical section extends along an entire interior vertical extent of both of the window opening section and the breast section, and wherein the second vertical section extends along an entire exterior vertical extent of only the window opening section along an exterior side of the window structure; and a horizontal connecting section connecting the first and second vertical sections.

2. The sliding window structure of claim 1, wherein a minimum height of the cavity in the breast section is approximately one half of a height of the window opening section.

3. The sliding window structure of claim 1, wherein, when the window structure is in a closed position, the two casements are arranged on top of the other, in a same vertical plane.

4. The sliding window structure of claim 1, wherein, when the window structure is in a fully opened position, the two casements are arranged side-by-side within the breast section, and the window opening section is free of the two casements and allows free communication of air therethrough.

5. The sliding window structure of claim 1, wherein at least a partial weight of each of the two casements is counter-balanced by a counter weight.

6. The sliding window structure of claim 1, further comprising more than two casements.

7. The sliding window structure of claim 1, wherein at least one additional casement is located in an uppermost region of the window opening section.

8. The sliding window structure of claim 7, wherein said at least one additional casement inlcudes one fixed position casement.

9. The sliding window structure of claim 1, wherein the horizontal connecting section is located at a half height of the window opening section.

10. The sliding window structure of claim 1, wherein said direction changing turn-outs comprise deflector arms.

* * * * *